United States Patent [19]

Wheeler

[11] 4,106,391

[45] Aug. 15, 1978

[54] MOTOR

[76] Inventor: Roland T. Wheeler, 744 Empire Ave., Modesto, Calif. 95351

[21] Appl. No.: 764,232

[22] Filed: Jan. 31, 1977

[51] Int. Cl.[2] ..... F01B 3/10

[52] U.S. Cl. ..... 91/481

[58] Field of Search ..... 91/481, 493; 417/510, 417/515-519

[56] References Cited

U.S. PATENT DOCUMENTS

| | | | |
|---|---|---|---|
| 546,055 | 9/1895 | Pitt | 91/493 |
| 759,828 | 5/1904 | Ocnoy | 91/493 |
| 780,640 | 1/1905 | Conway | 91/481 |
| 966,622 | 8/1910 | Thompson | 91/481 |
| 2,147,666 | 2/1939 | Park | 91/493 |
| 2,478,064 | 8/1949 | Hetzman | 91/493 |
| 2,952,219 | 9/1960 | Woydf | 91/481 |

FOREIGN PATENT DOCUMENTS

| | | | |
|---|---|---|---|
| 233,346 | 9/1963 | Austria | 417/518 |

*Primary Examiner*—William L. Freeh

*Attorney, Agent, or Firm*—Roger B. Webster

[57] ABSTRACT

A radial type, fluid pressure actuated (as distinguished from internal combustion) motor comprised of sets of opposed cylinders spaced in alinement and having double-acting pistons reciprocable therein, there being a crankshaft axially centered between the sets of opposed cylinders with the pistons of each set of said cylinders having a common connecting rod extending therebetween, each connecting rod being formed centrally of its ends with a Scotch yoke including a transverse, elongated slot, the yokes being disposed in adjacent side-by-side but right-angular intersecting relation, and the crankpin of the crankshaft extending in journaled but slidable relation through the slots of both yokes, and valves mechanically actuated from the yokes operative to feed fluid pressure to and exhaust the same from the cylinders in a predetermined cyclic order wherein the pistons of each set are simultaneously powered, in both directions of travel, and produce—by means of said connecting rods and yokes—continuous rotative motion of the crankshaft.

4 Claims, 4 Drawing Figures

FIG. 1
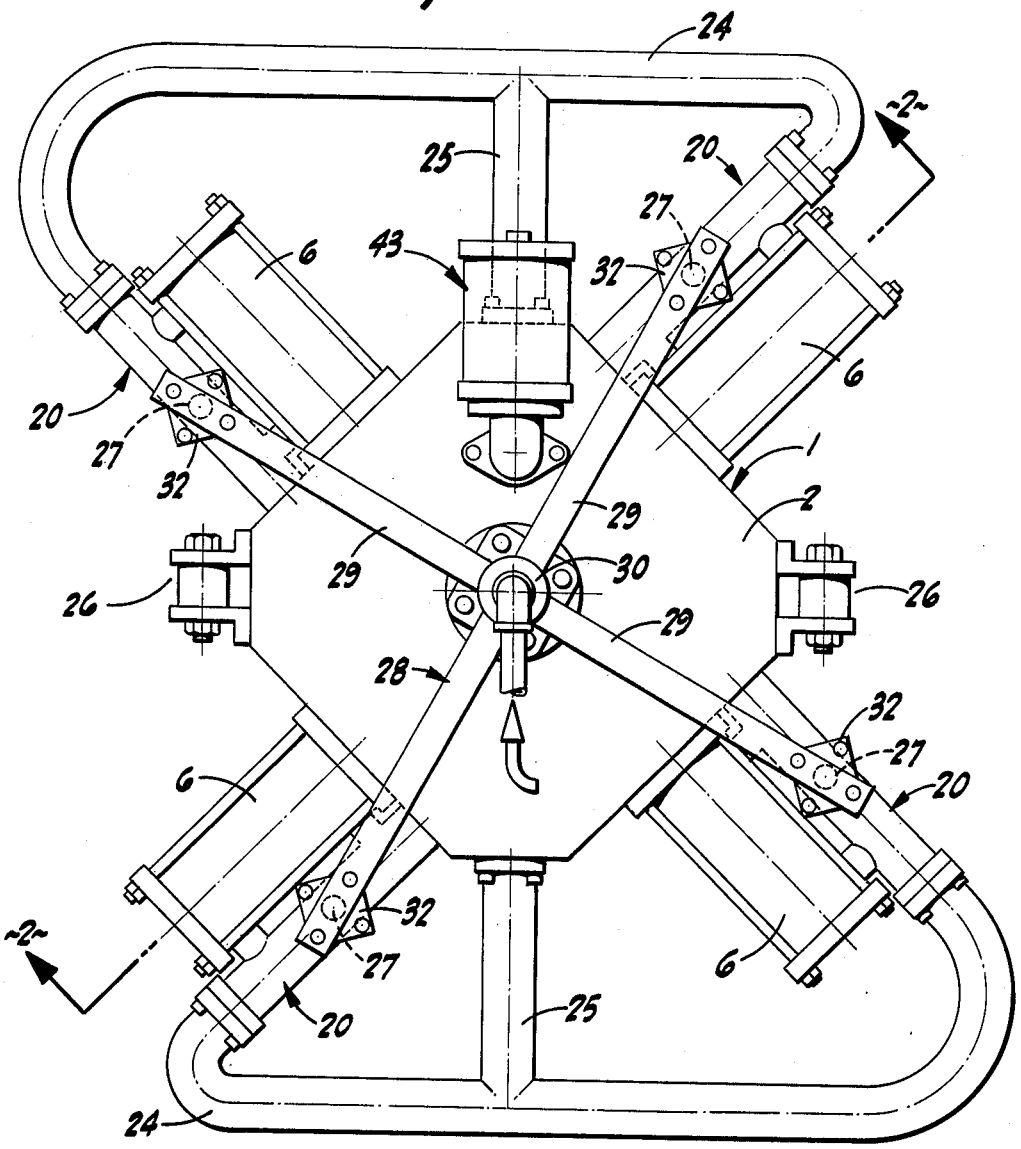
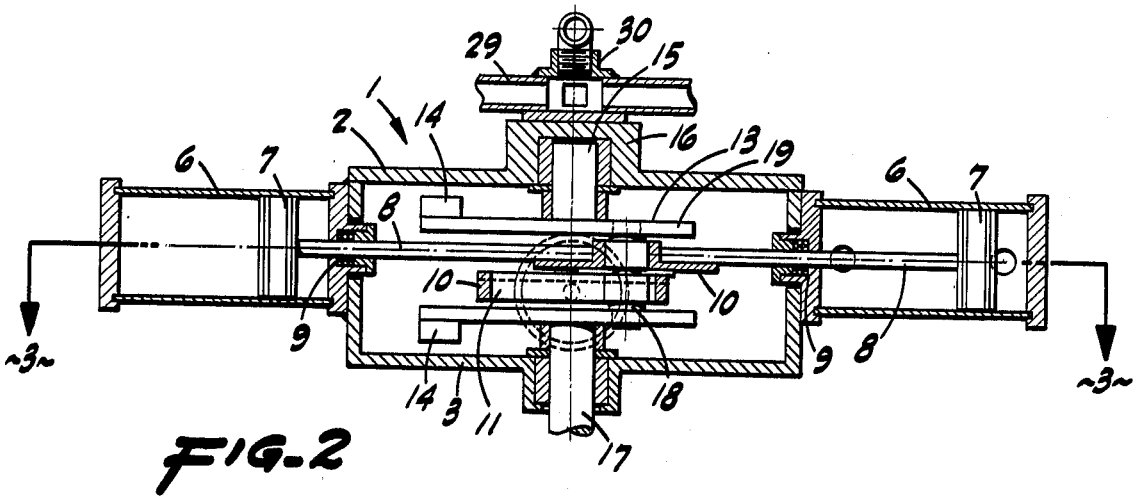
FIG. 2

MOTOR

BACKGROUND OF THE INVENTION

1. Field of the Invention

Understanding the current urgent need for a motor (or engine) which in operation is substantially pollution free in the sense of the ecology, I undertook the development of the concept of a non-internal combustion type motor which operates solely on exteriorly created fluid pressure such as air, or any vapor or fluid under pressure, and as derived from any suitable non-polluting power source, and which could conceivably be electrical, geothermal, nuclear, or the like. The herein disclosed motor is the result of a successful endeavor in such direction.

2. The Prior Art

U.S. Pat. Nos. 679,876; 787,925; 848,029 and 1,086,180 represent the prior art to the extent known to applicant, and applicant has no knowledge of any prior art disclosing the particular structure of the hereinclaimed motor.

SUMMARY OF THE INVENTION

The present invention provides, as a major object, a radial type, fluid pressure actuated motor which comprises sets of opposed cylinders spaced in alinement and having double-acting pistons reciprocable therein, there being a crankshaft axially centered between the sets of opposed cylinders with the pistons of each set of said cylinders having a common connecting rod extending therebetween, each connecting rod being formed centrally of its ends with a Scotch yoke including a transverse, elongated slot, the yokes being disposed in adjacent side-by-side but right-angular intersecting relation, and the crankpin of the crankshaft extending in journaled but slidable relation through the slots of both yokes, and valves mechanically actuated from the yokes operative to feed fluid pressure to and exhaust the same from the cylinders in a predetermined cyclic order wherein the pistons of each set are simultaneously powered in both directions of travel and produce—by means of said connecting rods and yokes—continuous rotative motion of the crankshaft.

The present invention provides, as an additional important object, a motor of the type described which—in operation—is pollution free, quiet running, operates at relatively high torque with rapid acceleration, produces relatively high horsepower for engine size and weight, is comparatively simple in structure, avoids the necessity of inclusion of conventional instrumentalities such as a carburetor, spark plugs, distributor, cam shaft, sprockets, and lifters, requires no starter, is axially narrow permitting of compact installation, may be run in any position, and is inexpensive to service, maintain, and operate.

The present invention provides, as a still further object, a practical, reliable, and durable motor, and one which is exceedingly effective for the purpose for which it is designed.

BRIEF DESCRIPTION OF THE DRAWINGS

FIG. 1 is a front elevation of the motor.

FIG. 2 is a radial cross section of the motor; the view being taken substantially on line 2—2 of FIG. 1.

DESCRIPTION OF THE PREFERRED EMBODIMENT

Figure 3:
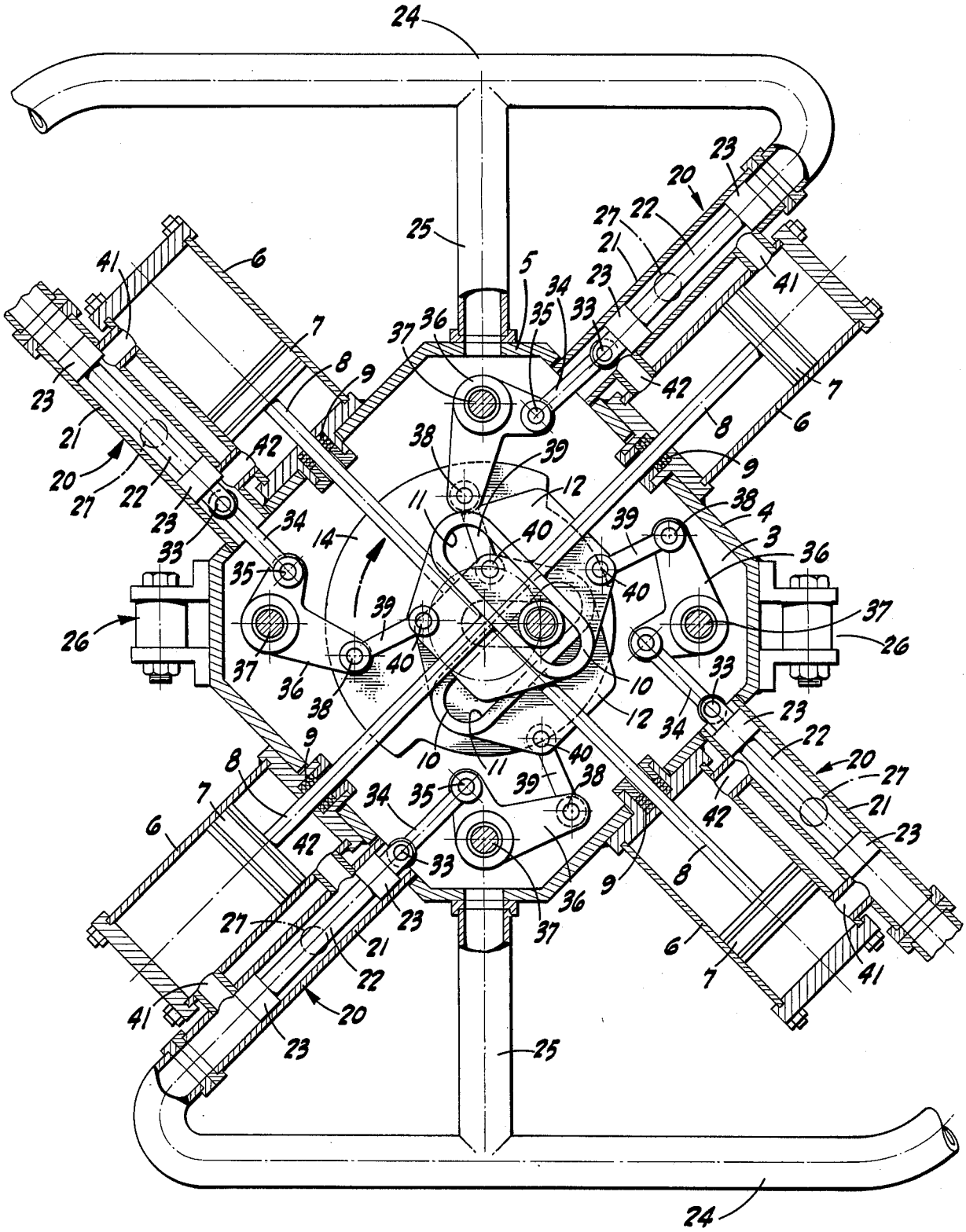
FIG. 3 is a sectional elevation of the motor; the view being taken substantially on line 3—3 of FIG. 2.

Referring now more particularly to the drawings and to the characters of reference marked thereon, the motor—in an axially horizontal position—comprises an upstanding, substantially rectangular, crankcase indicated generally at 1; such crankcase, which is axially relatively narrow, includes a front plate 2, a back plate 3, sides 4, and small, squared corners 5. The crankcase is disposed with the sides 4 extending at a 45° to vertical.

A cylinder 6 is mounted on, and radiates outwardly from, each side 4 of the crankcase 1; each set of opposed cylinders being axially alined, and the sets are slightly offset relative to each other, axially of the motor, for the reason which will later be understood.

The cylinders 6 each include a double-acting piston 7 reciprocably disposed therein, and the pistons 7 of each set of opposed cylinders 6 are coupled together by a common connecting rod 8 which runs from said cylinders through packings 9 and thence into the crankcase 1.

Centrally of the ends thereof, each connecting rod 8 is formed with a Scotch yoke 10 which includes a transverse, elongated slot 11; each slot extending at a right angle to the axis of the corresponding connecting rod 8, and the slots of the two rods intersecting in right-angular relation. Additionally, each yoke 10 is formed on opposite sides with flanges 12 which serve for connection of certain valve-actuating mechanism later to be described.

As the sets of opposed cylinders 6 are offset, relative to each other, axially of the motor, the connecting rods 8 and included yokes 10—while working close to each other—are not in engagement; the motor including an axial crankshaft 13 radially centered between said sets of opposed cylinders 6. The crankshaft 13, counterbalanced as at 14, includes an axial stub-shaft 15 journaled in a boss 16 on the front plate 2; while—in an oppositely projecting direction—there is another, and power output, shaft 17 journaled through the back plate 3.

The crankpin 18, of the crankshaft 13, extends—in journaled but shiftable relation—through the slots 11 of the right-angularly intersecting yokes 10, with the crank arms 19 remaining axially outwardly of, and in clearance relation to, said yokes.

Upon reciprocation of the pistons 7 of each set of opposed cylinders 6, with both pistons simultaneously fluid pressure powered during each stroke, and with the pistons of the separate sets of opposed pistons being so powered in a predetermined cyclic relation, the power thrust, derived from such reciprocating pistons working under fluid pressure as later described, is translated, by the yokes 10—acting on the crankpin 18—into smooth and continuous rotation of the crankshaft 13.

The pistons 7 of both sets of the opposed cylinders 6 are fluid pressure actuated—in the desired cyclic relation—by means of a pressure feed and control valve system as follows:

An elongated spool-type, slide valve, indicated generally at 21, corresponds to, and is fixedly mounted in adjacent parallel relation to, each cylinder 6; each slide valve 20 including a tubular sleeve 21 which houses an axially slidable or reciprocable spool 22 having axially spaced heads 23, with the spool of reduced diameter between such heads.

The tubular sleeve of each slide valve 22 is open at its inner end to the interior of the crankcase 1, while at the outer end each sleeve is connected in communication with an exhaust pipe 24 as shown in FIG. 1. Each such exhaust pipe 24 includes a substantially central leg 25 which extends to the near corner 5 of the crankcase 1, and there opens into the latter. The exhaust pipe legs 25 connect to the crankcase 1 at the upper and lower corners 5, while the side corners are provided with motor mounts indicated generally at 26.

Each slide valve 20 includes, in the sleeve 21, a fluid pressure inlet port 27 disposed centrally of the ends of such sleeve, and fluid pressure is fed simultaneously to such ports 27 by means of an exterior manifold 28 positioned on the front of the motor; such manifold 28 being of cross form and includes feed tubes 29 connected at their inner ends to a fitting 30 to which a fluid pressure supply conduit 31 is coupled.

Adjacent their outer ends, the tubes 29 of manifold 28 are connected in communication with the related inlet ports 27 of the slide valve 20; the tube attachment pads being indicated at 32.

At the inner end thereof, the slidable spool 22 of each valve of each set of cylinders is pivotally attached, as at 33, to the near or outer end of an inwardly extending link 34 whose inner end is pivoted, as at 35, to one end of a bellcrank lever 36 journaled, as at 37, to the back plate 3 in clearance relation to the paths of travel of the yokes 10. The other end of the bellcrank lever 36 is pivoted, as at 38, to one end of a link 39 whose other end, and at a predetermined point, is pivoted, as at 40, to the near flange 12 of the yoke 10 of the other set of cylinders. The flange 12 on the opposite side of the same yoke serves for pivotal attachment of the link 39 related to the valve 20 of the opposed cylinder 6.

With the link and lever arrays (34-36-39), as described above, it will be recognized that reciprocation of the yokes will produce corresponding reciprocation of the spools 22 of the valves 20 and in a predetermined cyclic order.

Each valve 20 includes an outer port 41 and an inner port 42 in communication between the sleeve 21 and the adjacent cylinder 6; the ports 41 and 42, which are disposed with the inlet port 27 centrally therebetween, are spaced apart a distance having predetermined relation to the spacing of the spool heads 23. The ports 41 and 42 are positioned short of the related ends of the sleeve 21 whereby upon full reciprocation of the spool 22—by the corresponding link and lever array—the spool successively occupies opposite positions in the sleeve 21, and in which positions communication is established first, through port 41, between inlet port 27 and the cylinder 6, and then, through port 42, between such inlet port 27 and said cylinder. At the same successive times, the spool 22 uncovers ports 42 and 41 to permit cylinder exhaust from the ends of the sleeve 21 directly into the crankcase 1 in one instance, and into the related exhaust pipe 24 in the other instance.

Thus, upon reciprocation of each spool 22 of each valve 20, fluid pressure is delivered alternately into the corresponding cylinder 6 on opposite sides of the piston 7 whereby said piston is caused to reciprocate with a double-acting effect; the cylinder 6 being effectively exhausted on the side of the piston opposite that to which the fluid pressure is applied.

Upon introduction—under suitable throttle control—of fluid pressure into the feed manifold 28, and consequently to the inlet port 27 of all four valves 20, the motor—irrespective of the position of said valves 20 and the piston 7—starts, without more, to operate.

In operation of the motor, the described link and lever arrays (34-36-39) are—as heretofore noted—arranged to reciprocate the valves 20 (i.e., the spools 22 thereof) so that in each set of opposed cylinders, the pistons are powered simultaneously and in the same direction on each stroke. In other words, pressure is applied at the same time to one piston from one side and to the other piston from the other side; this, of course, in alternation, and with alternate exhaust, as the motor operates.

The sequencing or cycling, as controlled by the separate link and lever arrays, is such that—upon the pistons, of one set of opposed cylinders, reaching the end of a stroke—the pistons of the other set of opposed cylinders occupy a mid-position of a stroke. The cycling of the pistons of the motor, and the respective successive positions thereof (and other parts) in the operation of the motor, is depicted diagrammatically in FIG. 4 of the drawings.

By the employment of the described compound or double-yoke, crankshaft-actuating arrangement of the motor, and by powering the pistons in both directions of travel in each stroke—with effective cycling by the link-lever operated slide valves 20—the motor, adaptable to universal uses including automotive, functions smoothly with effective and relatively great power output for motor size and weight.

In order to lubricate the working parts of the motor, it is contemplated that the fluid, under pressure, used to operate the motor will carry—in suspension or as a vapor—a high quality lubricant. Hence, as the fluid pressure moves through the motor, including exhaust into the crankcase, all moving parts are effectively lubricated. The fluid pressure, as exhausted into the crankcase, is—in the absence of means to feed it back to the pressure source—released therefrom in suitable manner, as by a combination filter and muffler indicated generally at 43.

Figure 4:
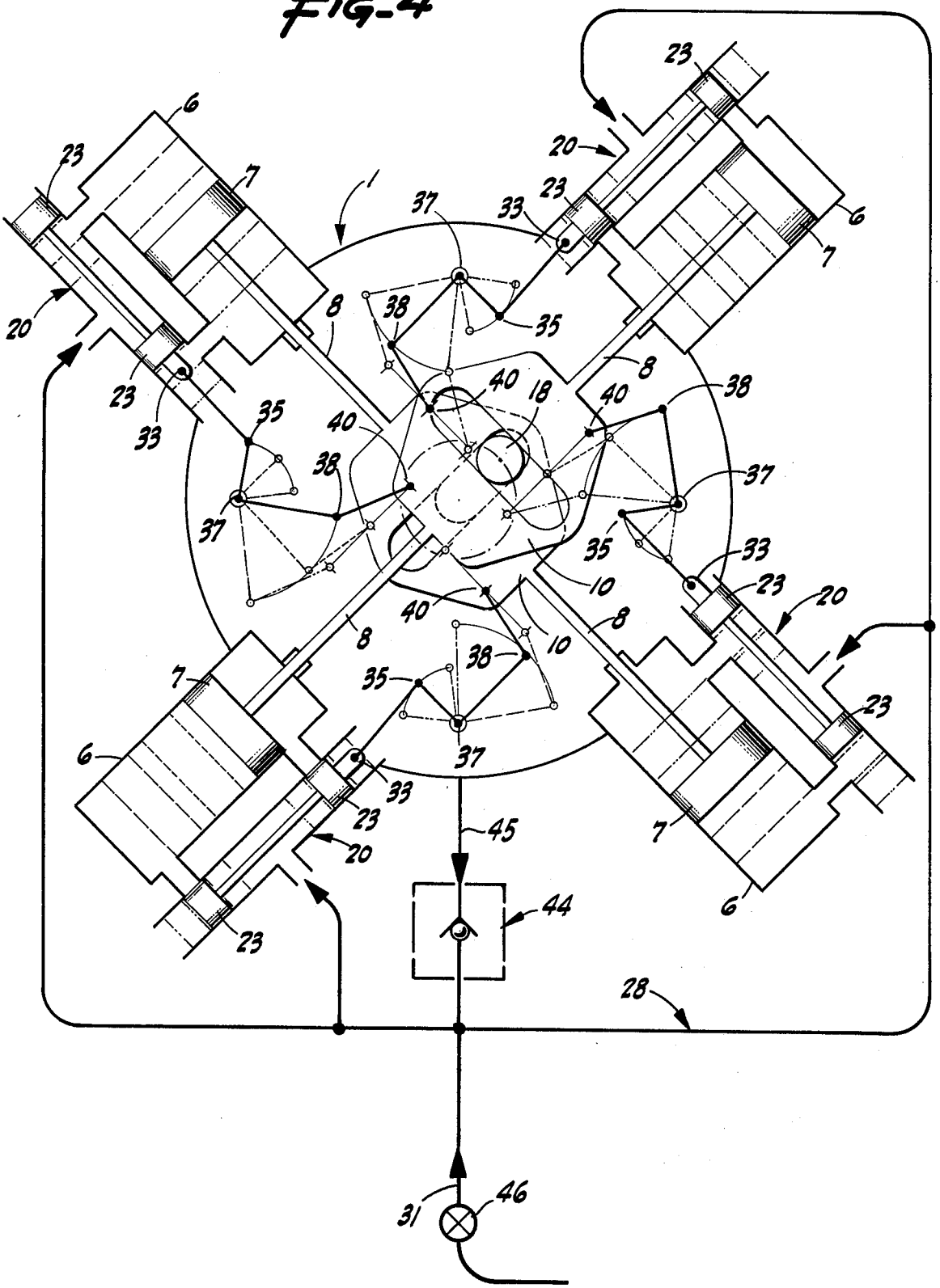
FIG. 4 is a diagrammatic view (corresponding generally to FIG. 3) showing relative cyclic positions of the parts—including the pistons, control valves, and actuating mechanism for the latter—during a revolution of the motor.

By diagrammatic illustration in FIG. 4, and as an exemplary disclosure, a check valve 44 is interposed in suitable passage means 45 extending in communication between the fluid pressure feed manifold 28 and the interior of the crankcase 1; such check valve 44 being of one-way type, closing in the direction of said crankcase 1 and opening in the direction of the fluid pressure feed manifold 28. In actual practice the check valve 44 is preferably associated with the fitting 30.

More particularly, the check valve 44, which may be of any suitable structural form, is operative in a manner such that it is normally closed, i.e., when there is pressure flow in the throttle controlled, fluid pressure supply conduit 31, with the throttle valve 46 open and the motor functioning under power.

However, upon cessation of fluid pressure flow in supply conduit 31, as when the throttle valve 46 is closed, but with continued, non-powered rotation or coasting of the motor—as, for example, when in automotive use—a suction effect is produced in manifold 28, the check valve 44 is drawn open, and there is a consequent fluid circulation throughout the motor and so that it "freewheels". This prevents back pressure, conserves energy, dissipates heat, and assures of continued proper lubrication.

If for any reason, and during time-limited periods of use, a back pressure induced braking effect in the motor is desired, valve 44 may be suitably arranged so that—either under automatic or manual control—such valve 44 is held closed whereby fluid circulation throughout the motor is prevented upon cessation of the pressure flow in fluid pressure supply conduit 31.

From the foregoing description, it will be readily seen that there has been produced such a motor as substantially fulfills the objects of the invention as set forth herein.

While this specification sets forth in detail the present and preferred construction of the motor, still in practice such deviations from such detail may be resorted to as do not form a departure from the spirit of the invention as defined by the appended claims.

I claim:

1. A radial type, fluid pressure actuated motor comprising a support, sets of opposed cylinders mounted on the support, the cylinders of each set being spaced in alinement, pistons reciprocable in such cylinders, a support-mounted crankshaft axially centered between the sets of opposed cylinders, a connecting rod extending in common between the pistons of each set of opposed cylinders, each connecting rod being formed centrally of its ends with a yoke having an elongated transverse slot therein, the yokes being disposed side by side with the slots in intersecting relation, the crankpin of the crankshaft extending in journaled but slidable relation through the slot of both yokes, a fluid pressure supply conduit, valves corresponding to each cylinder of each set thereof, and motion-transmitting means connected to and extending between the yokes and valves operative to cause actuation of the latter to effect feed of fluid pressure from said conduit to, and exhaust the same from, the cylinders in a predetermined cyclic order wherein the pistons of each set are simultaneously powered on each stroke, and produce, through the medium of said connecting rods and yokes, rotative motion of the crankshaft; said motion-transmitting means including, for each valve of each set of cylinders, one part connected to the valve, and another part connected to the yoke of the other set of cylinders.

2. A radial type, fluid pressure actuated motor comprising a support, sets of opposed cylinders mounted on the support, the cylinders of each set being spaced in alinement, pistons reciprocable in such cylinders, a support-mounted crankshaft axially centered between the sets of opposed cylinders, a connecting rod extending in common between the pistons of each set of opposed cylinders, each connecting rod being formed centrally of its ends with a yoke having an elongated transverse slot therein, the yokes being disposed side by side with the slots in intersecting relation, the crankpin of the crankshaft extending in journaled but slidable relation through the slots of both yokes, a fluid pressure supply conduit, valves corresponding to each cylinder of each set thereof, and motion-transmitting means connected to and extend-between the yokes and valves operative to cause actuation of the latter to effect feed of fluid pressure from said conduit to, and exhaust the same from, the cylinders in a predetermined cyclic order wherein the pistons of each set are simultaneously powered on each stroke, and produce, through the medium of said connecting rods and yokes, rotative motion of the crankshaft; said motion-transmitting means including, for each valve of each set of cylinders, a bellcrank lever pivotally mounted on the support, one link pivotally connected between the valve and one end of the bellcrank lever, and a second link pivotally connected between the other end of the bellcrank lever and the yoke of the other set of cylinders.

3. A radial type, fluid pressure actuated motor comprising a support, sets of opposed cylinders mounted on the support, the cylinders of each set being spaced in alinement, pistons reciprocable in such cylinders, a support-mounted crankshaft axially centered between the sets of opposed cylinders, a connecting rod extending in common between the pistons of each set of opposed cylinders, each connecting rod being formed centrally of its ends with a yoke having an elongated transverse slot therein, the yokes being disposed side by side with the slots in intersecting relation, the crankpin of the crankshaft extending in journaled but slidable relation through the slots of both yokes, a fluid pressure supply conduit, valves corresponding to each cylinder of each set thereof, and motion-transmitting means connected to and extending between the yokes and valves operative to cause actuation of the latter to effect feed of fluid pressure from said conduit to, and exhaust the same from, the cylinders in a predetermined cyclic order wherein the pistons of each set are simultaneously powered on each stroke, and produce, through the medium of said connecting rods and yokes, rotative motion of the crankshaft; each valve of each set of cylinders including a reciprocable spool slidably enclosed in a tubular sleeve extending lengthwise alongside the corresponding cylinder, the sleeve being open at its inner end; and the motion-transmitting means including, for each valve of each set of cylinders, one part connected to the spool adjacent said open end of the sleeve, and another part connected to the yoke of the other set of cylinders.

4. A motor, as in claim 3, in which said motion-transmitting means further includes, for each valve of each set of cylinders, a bellcrank lever pivotally mounted on the support; said one part being a link pivotally connected to and extending between the spool and one end of the bellcrank lever, and said other part being a link pivotally connected to and extending between the other end of the bellcrank lever and the yoke of said other set of cylinders.

* * * * *